US006361129B1

(12) United States Patent
Börgen

(10) Patent No.: US 6,361,129 B1
(45) Date of Patent: Mar. 26, 2002

(54) WINE RACK AND DISPLAY SHELF

(76) Inventor: Arden L. Börgen, 2504 Forest Dr., Des Moines, IA (US) 50312

( * ) Notice: Subject to any disclaimer, the term of this patent is extended or adjusted under 35 U.S.C. 154(b) by 0 days.

(21) Appl. No.: 09/574,292

(22) Filed: May 19, 2000

Related U.S. Application Data

(60) Provisional application No. 60/135,253, filed on May 21, 1999.

(51) Int. Cl.[7] ..... A47F 7/28

(52) U.S. Cl. ..... 312/128; 211/74

(58) Field of Search ..... 211/591, 74; 312/116, 312/117, 118, 45, 42, 60, 72, 73, 121, 126, 128

(56) References Cited

U.S. PATENT DOCUMENTS 2,273,233 A * 2/1942 Tanner ..... 312/128 X
3,896,936 A * 7/1975 Notarius ..... 211/74
4,022,327 A 5/1977 Anderson
4,220,245 A * 9/1980 Corcoran ..... 211/74 X
4,482,065 A * 11/1984 Altemose ..... 211/74
4,546,887 A * 10/1985 Cohn ..... 211/74 X
5,586,665 A * 12/1996 Brousseau ..... 312/72 X
5,595,310 A * 1/1997 Spamer et al. ..... 211/74 X
6,003,685 A * 12/1999 Malin ..... 211/59.1 X
6,173,845 B1 * 1/2001 Higgins et al. ..... 211/74

* cited by examiner

*Primary Examiner*—Peter M. Cuomo
*Assistant Examiner*—Michael J. Fisher
(74) *Attorney, Agent, or Firm*—Zarley McKee Thomte, Voorhees & Sease PLC

(57) ABSTRACT

A wine rack and display shelf is adapted to cellar and display bottles of various shapes and sizes. The wine rack is capable of receiving and storing bottles in a generally horizontal position which has the benefit of preserving the moisture of the cork. The horizontal storage method is generally accepted as the most preferred method for long term storage. In addition, the wine rack and display shelf can also display and exhibit the bottles so that one selecting a bottle can view the label or other designations without the need to pull one of the horizontal bottles. This vertical display can also be used to allow the wine to breathe while maintained in the storage area where the environment is maintained at a preferred level.

13 Claims, 10 Drawing Sheets

WINE RACK AND DISPLAY SHELF

CROSS-REFERENCE TO RELATED APPLICATIONS

This application claims the benefit of U.S. Provisional Application No. 60/135,253 filed May. 21, 1999.

BACKGROUND OF THE INVENTION

A. Field of the Invention

The invention relates generally to bottle holders and especially to wine bottle storage and display. In particular, this invention concerns a wine rack for supporting a plurality of bottles lying on their sides while at the same time allowing support for a plurality of bottles in a "cork up" or display position.

B. Description of the Prior Art

The proper storage of bottled wines, spirits and beers is important since these beverages can represent a sizeable investment especially when large purchases are involved. Therefore they should be treated with care and due regard for their perishable qualities. The generally accepted manner for storing wines in order to keep the wine "healthy" is to place the bottle in a bin so that it rests on its side and the cork stays moist. This prevents the cork from drying out and allowing air to enter the bottle. Similarly, other beverages such as sparkling wine need to be stored on their side. A dried out cork allows gas to escape resulting in a "flat" wine. Ideally, a storage device should be located in a well ventilated, cool, dark place having a fairly constant temperature of about 55 to 65° F.

The storage and display unit should be designed so as to avoid unnecessary movement or vibration of the bottles which can disturb the sediment therein.

In the prior art, wine racks conventionally provide a bottle cradling surface for supporting the bottle in a horizontal or "cork down" position. Many of these racks are erected in a honeycomb framework or with various rows where a bottle is cradled in its horizontal situation. There are many variations in the design of these bins or racks 11 (FIG. 2) which can accommodate different designs and storage capacities.

In a commercial setting, however, it is often desired to display the label of the wine so as to allow a potential purchaser to view the label without unnecessary handling and shifting of bottles stored in a rack. Again, any unnecessary movement of the bottles over a period of time can cause agitation of the sediment at the bottom of the wine bottle and can affect the aging and flavor of many wines and beverages. It would be desirable to display and cellar the wine simultaneously.

The improved wine rack and display shelf of this invention overcomes many of the problems found in the prior art while combining both a wine rack and display mechanism for use in a variety of circumstances, primarily in commercial display environments. This combination of cellaring and display is unique in the art. The bottles are supported on their sides and can be easily slid out of the rack without disturbance of adjacent bottles. At the same time, some bottles are displayed in a "cork up" or vertical position so that a consumer of the wine can easily view the label or can allow the wine to "breathe" with the cork removed, without removing the wine from a display container or from the environment which is, as described above, uniquely maintained to allow aging and preservation of the wine.

SUMMARY OF THE INVENTION

The present invention maintains a plurality of bottles in the horizontal or "cork down" position while also having the ability to display bottles, and their labels, in a "cork up" position so that the wine from the group can be selected without unnecessarily removing many bottles to find the vintage or type of wine desired.

Basically, the wine rack of the present system is incorporated into a wine cooler which maintains the environment immediately adjacent the bottles of wine in a desired range of temperature, humidity, and the like. Within this cooler is a plurality of cantilevered rods which extend away from the rear wall of the cooler. A shelf standard is attached to the rear wall. A back plate is attached to the standard to support the rods. The rods are spaced so as to receive one bottle for every two rods when that bottle is placed in the horizontal or "cork down" position. Likewise, below a number of rods is a shelf which is cantilevered again from the back plate and rear wall and extends beyond the rods such that bottles of wine can be positioned in a vertical or "cork up" position so as to display their labels, or to allow the wine to breathe once the cork has been removed.

The introduction of this dual purpose cooler, to cellar and display, is especially suited for those commercial environments where concerns surround not only the storage of the wine, but the display of the bottles for potential customers.

Specifically, it is an object of this invention to provide a wine rack and display shelf which allows wine to be both stored in an appropriate environment while being simultaneously displayed if desired in a "cork up" position, so as to function.

Another objective of the present invention is to provide a cooler which incorporates both "cork up" and "cork down" display and storage in order to maximize purchasing availability and label display of various wines and bottled beverages.

Still another object of this invention is to provide a wine rack and display shelf wherein the wine bottles are adequately supported in all positions.

Another object of this invention is to provide a wine rack and support shelf having bottle storage which can accommodate a wide range of bottle shapes and sizes.

Still another object of this invention is to provide a wine rack and display shelf which allow access to bottles while reducing disturbances for other bottles within the cooler or display.

The above and other objectives, features, and advantages of this invention will be apparent from the following description of the preferred embodiment when considered in connection with the accompanying drawings.

DETAILED DESCRIPTION OF THE DRAWINGS

In the accompanying drawings in which are shown the preferred embodiment of this invention:

DETAILED DESCRIPTION OF THE INVENTION

Figure 1:
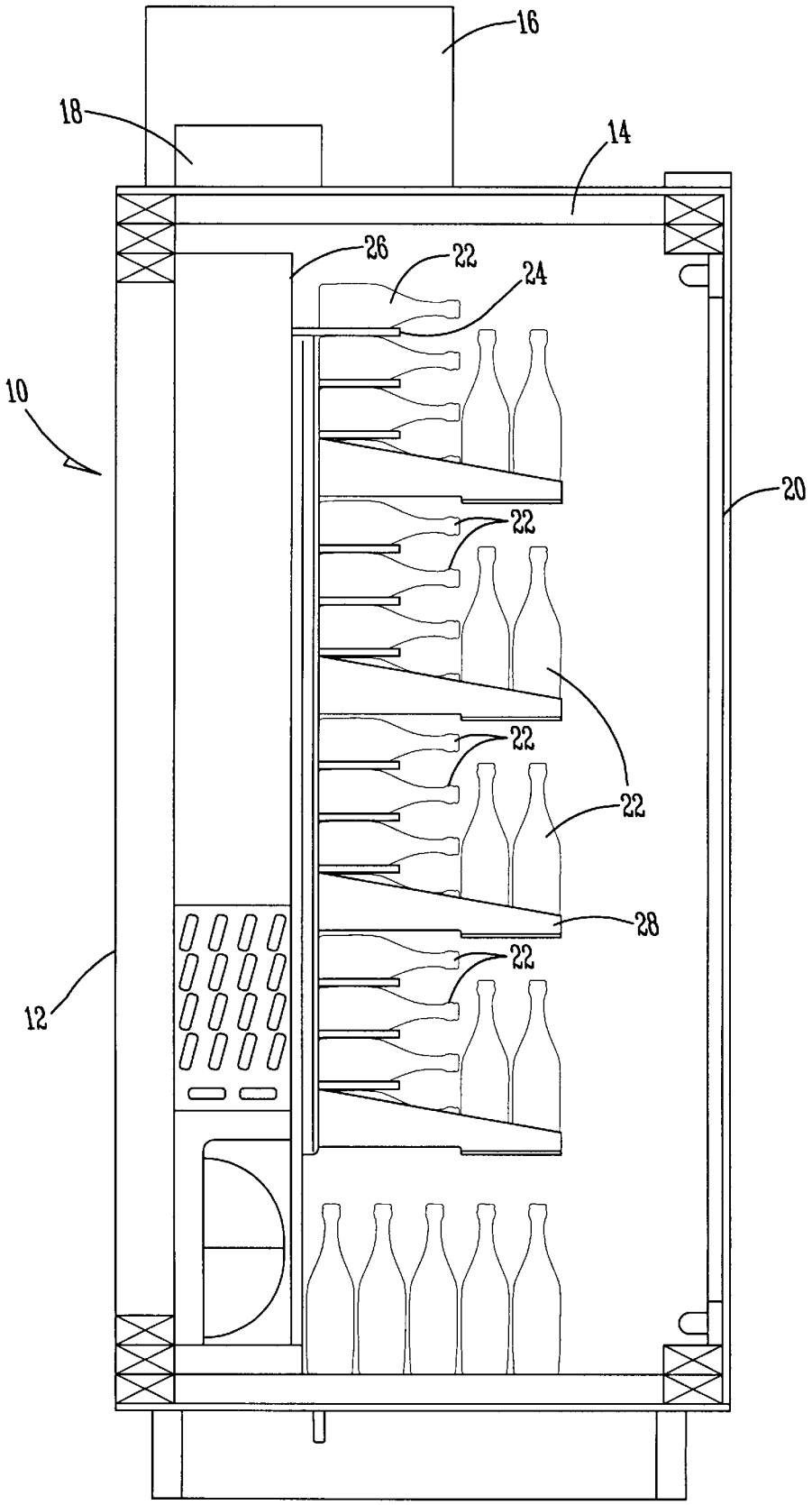
FIG. 1 is a side elevational and sectional view of a preferred embodiment of this invention.
Figure 2:
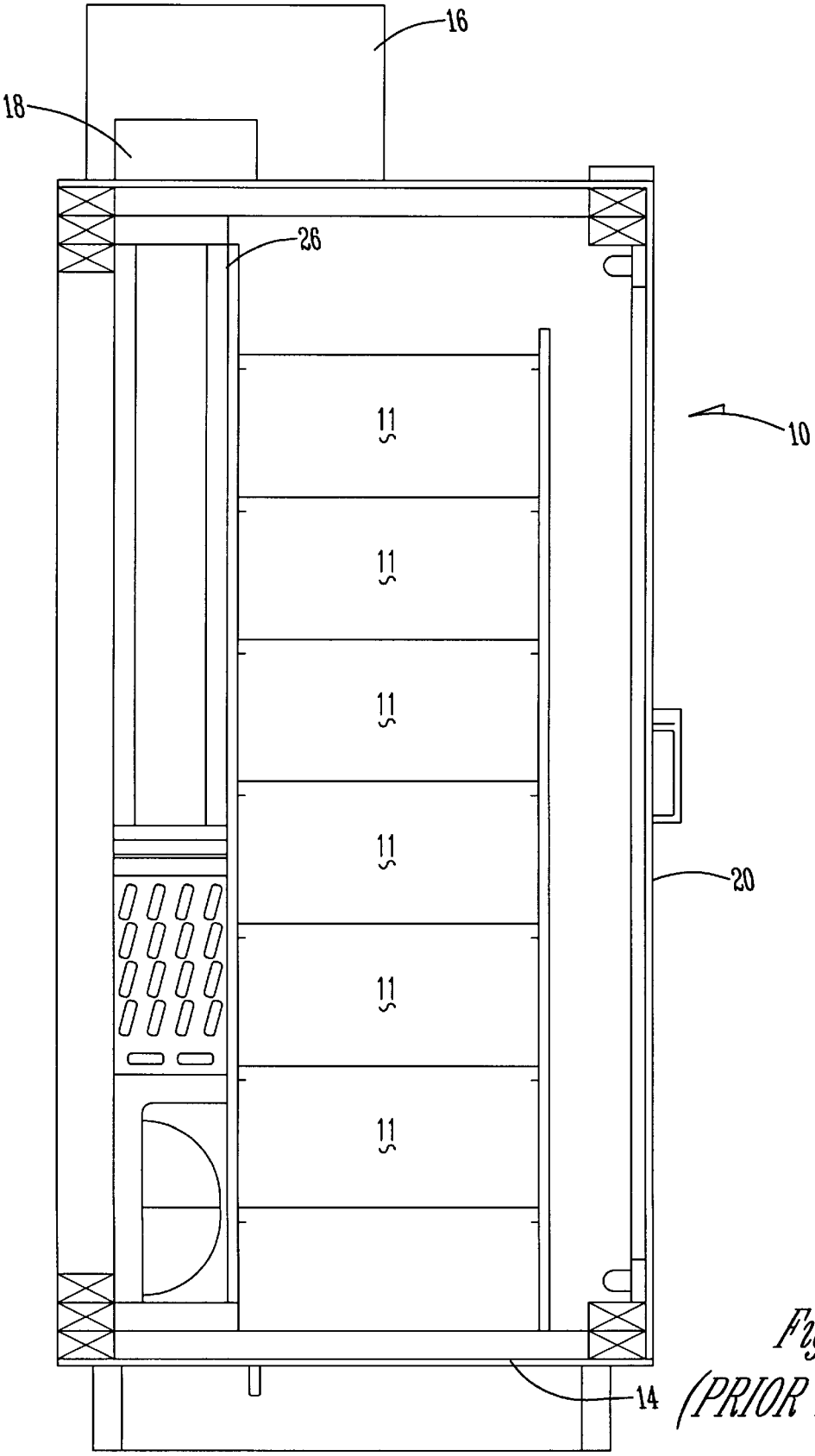
Fig.2 (PRIOR ART)
FIG. 2 is a side elevational and sectional view of the prior art showing wire rack shelves.
Figure 3:
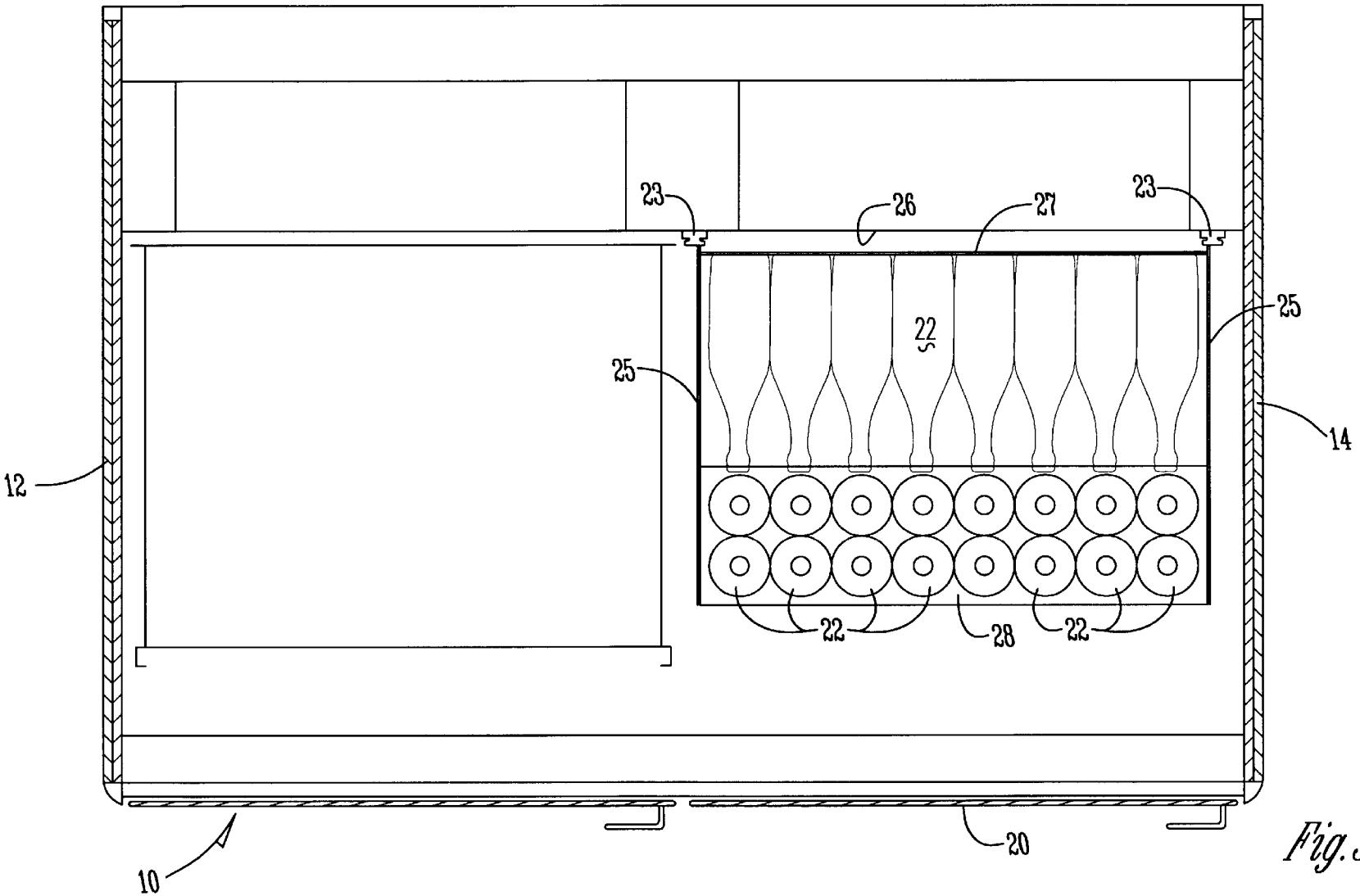
FIG. 3 is an overhead sectional view of the preferred embodiment of this invention.

Referring now in detail to the drawings, the reference numeral 10 refers generally to an improved wine rack and storage display shelf contained within a cooler. The cooler 12 includes an outer housing 14, a condensing unit 16, ballast 18 to maintain the stability of the housing 14, and a glass door 20 which allows access to the interior products.

Bottles of wine 22 are shown displayed within the cooler 10.

Figure 4:
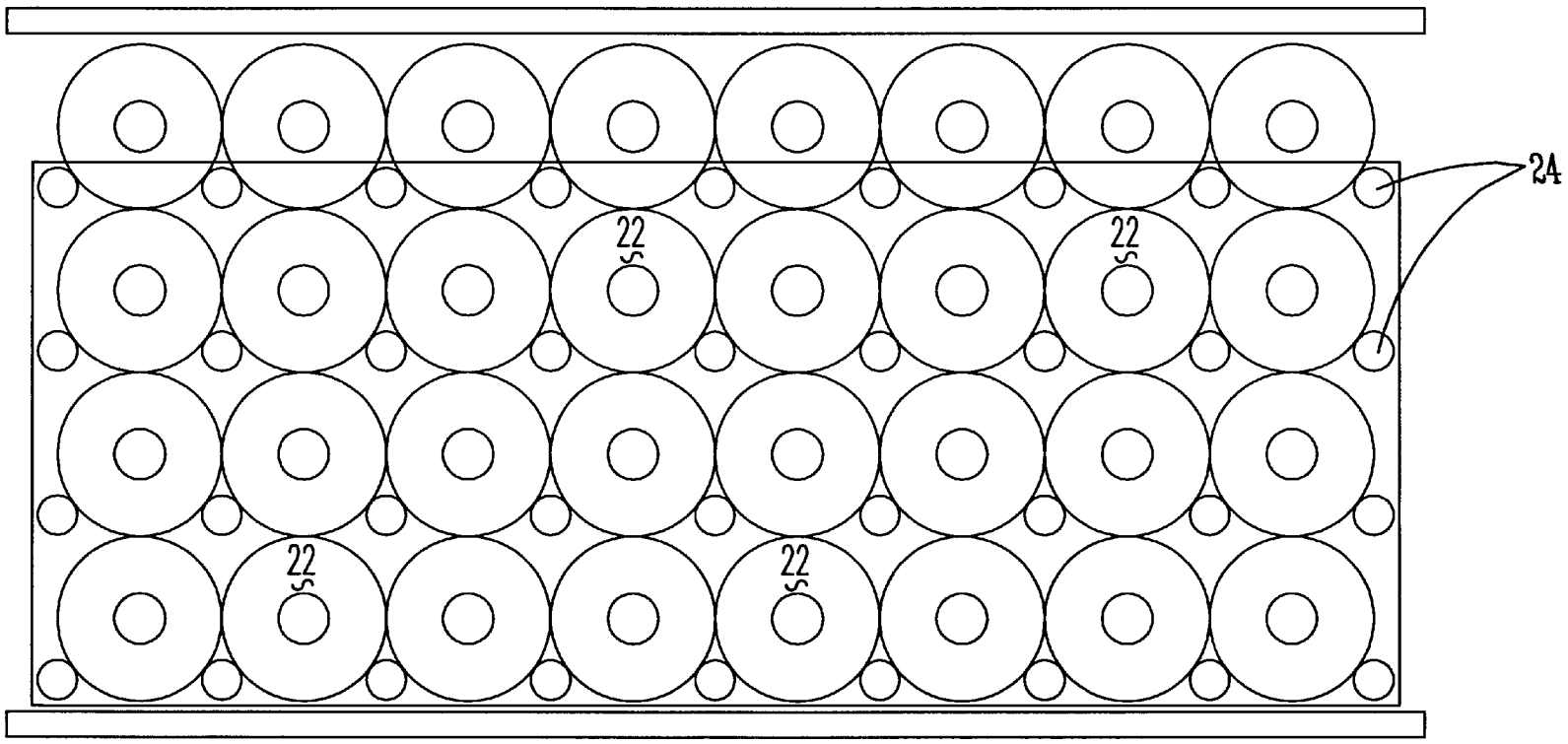
FIG. 4 is a front elevational view showing wine bottles in a horizontal or "cork down" position.
Figure 5:
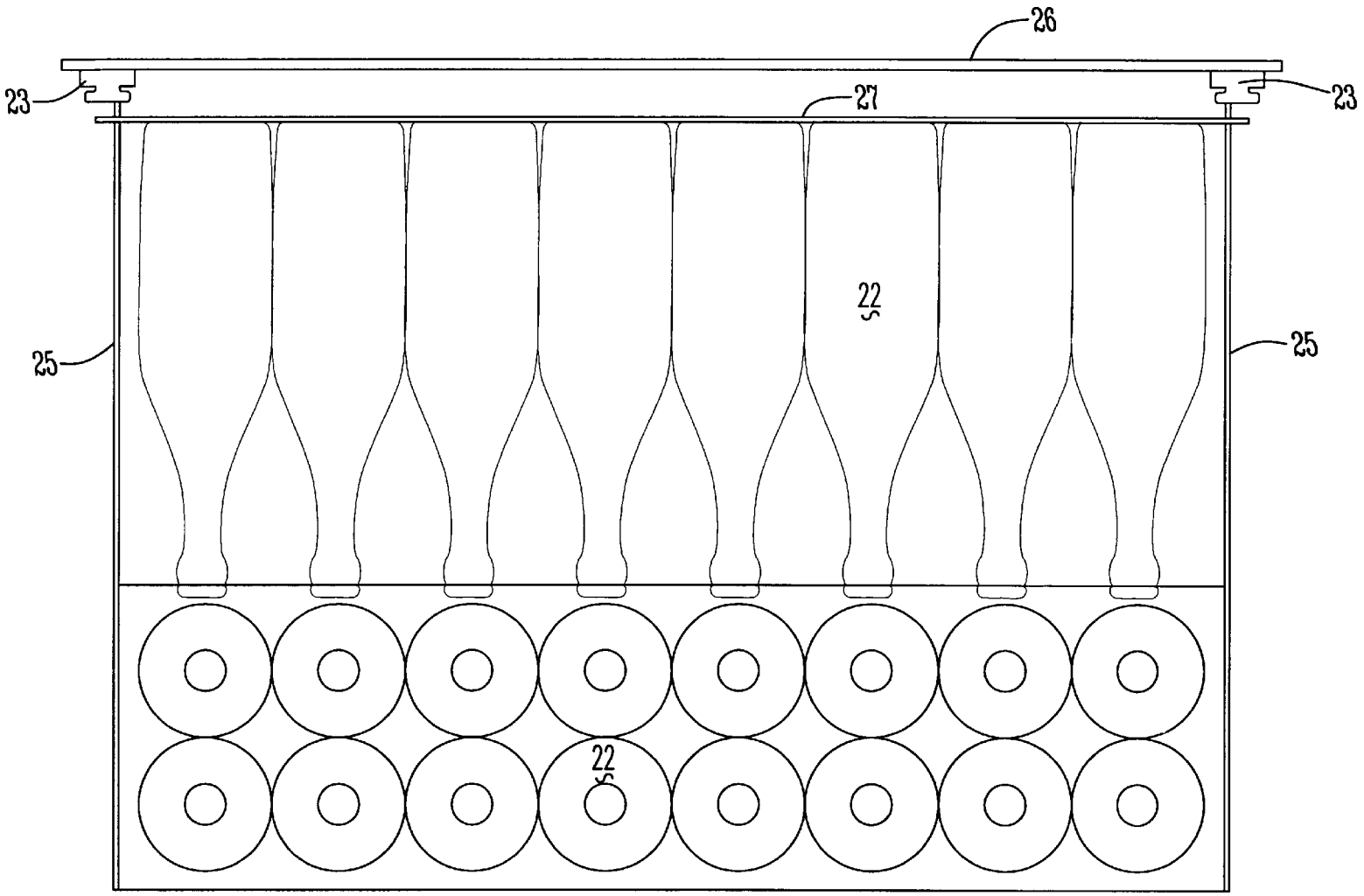
FIG. 5 is a top plan view showing bottles in both the horizontal or "cork down" position as well as bottles in the vertical or "cork up" position.
Figure 6:
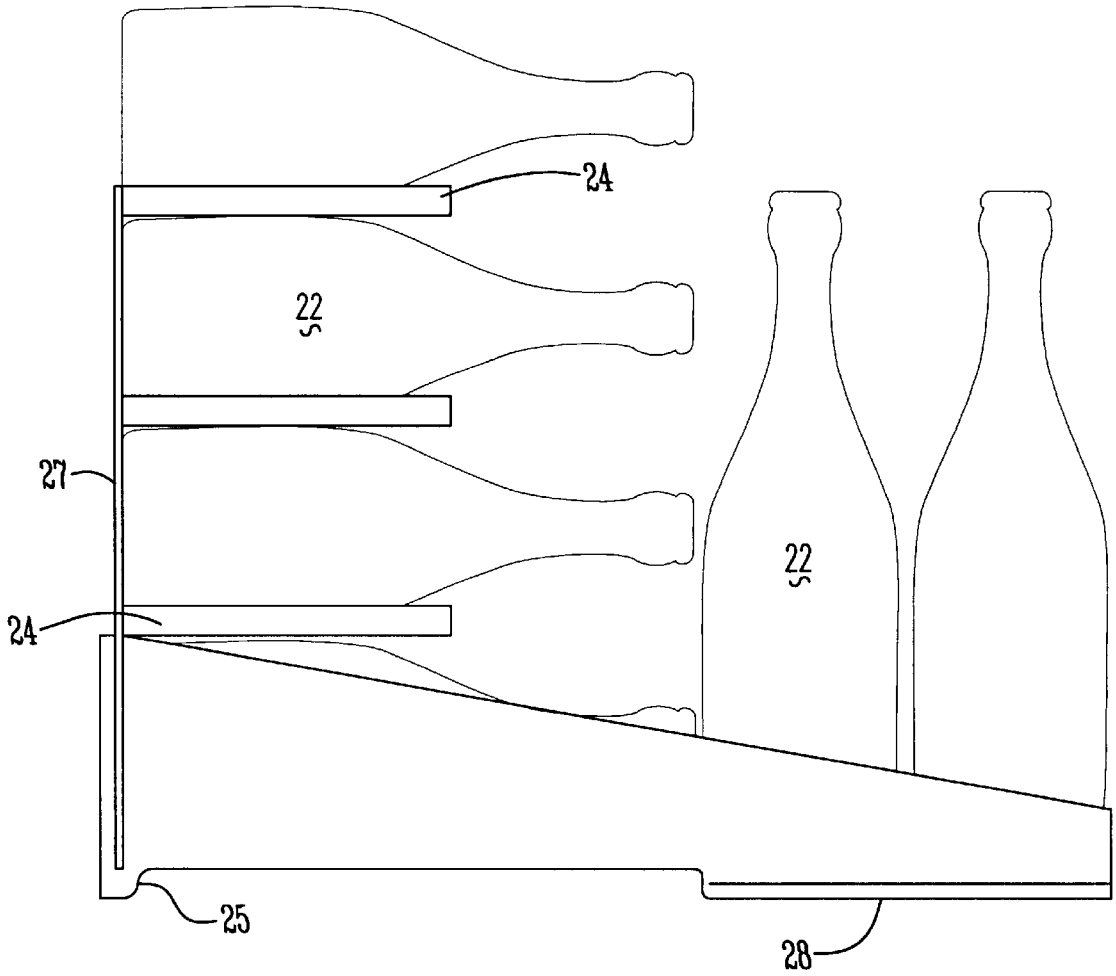
FIG. 6 is a side elevational view showing wine displayed in the preferred embodiment of the invention in both a horizontal and vertical relationship.

As best shown in FIGS. 4–6, the bottles of wine 22 are supported by rods 24 extending from the rear wall 26 of the cooler 12. A shelf standard 23 is positioned on the rear wall. An attachment bracket 25 is mounted on the shelf standard 23 and supports a back plate 27. These rods 24 are cantilevered from the back plate 27 and positioned so as to receive a bottle of wine 22 when rested between two rods 24. Rods 24 will support the bottle of wine 22 in a horizontal or "cork down" position. The rods 24 of the back plate 27 can be arranged in one of many unique orientations to provide for storage of different size and shaped bottles.

Figure 7:
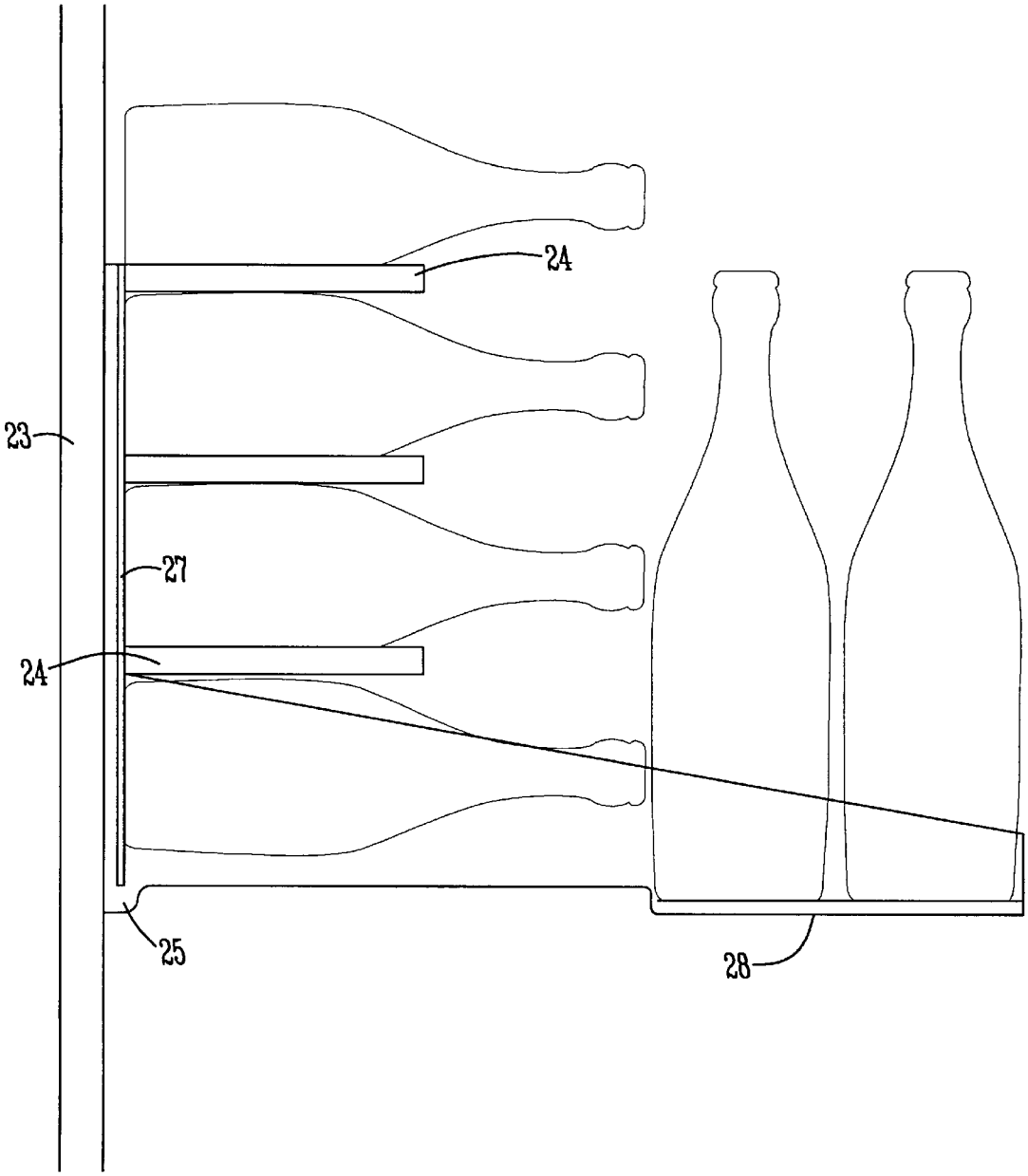
FIG. 7 is a side elevational view showing wine bottles in a horizontal and vertical relationship.
Figure 8A:
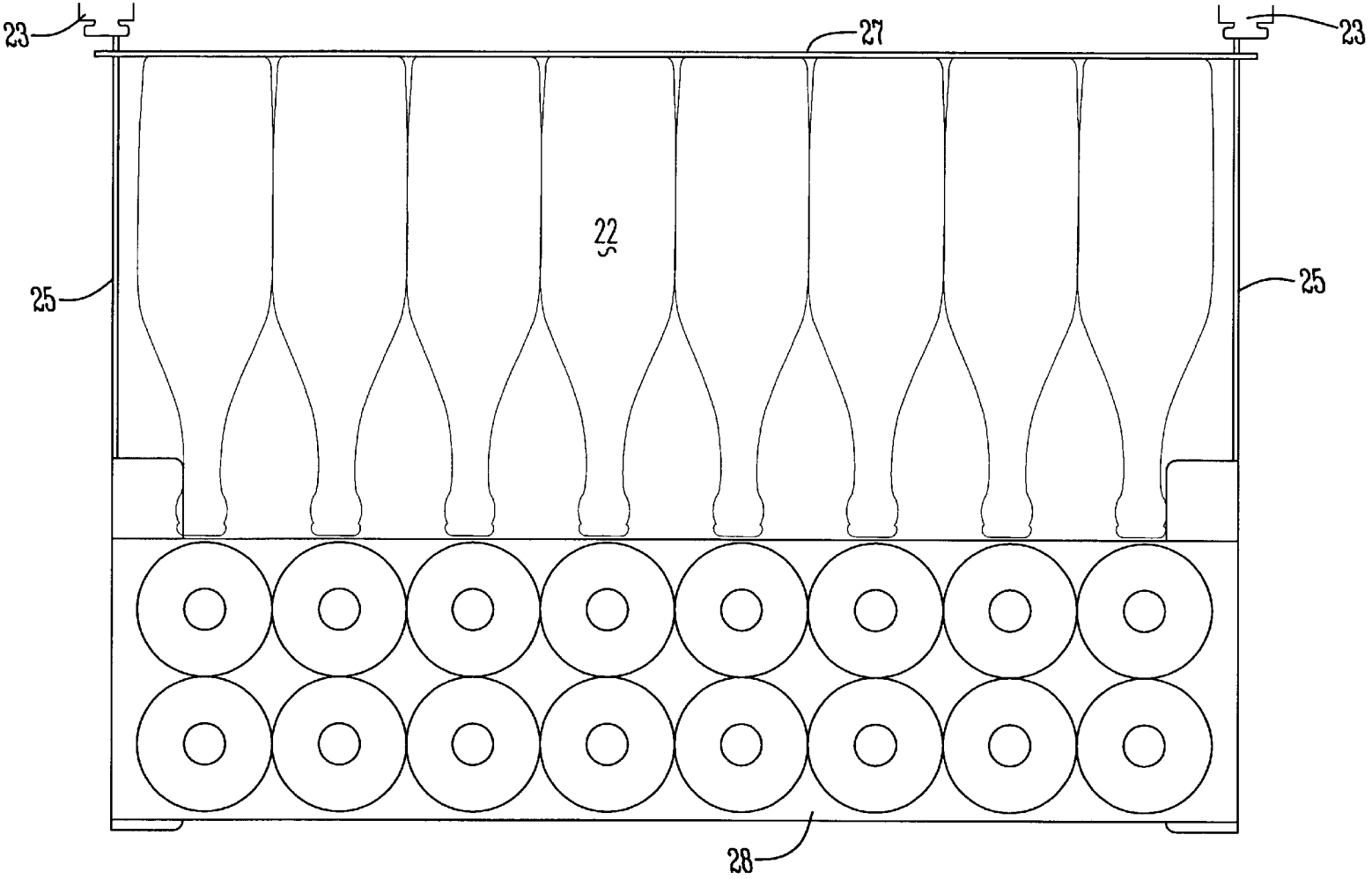
FIG. 8A is a top plan detail view showing the "cork down" and "cork up" storage.
Figure 8B:
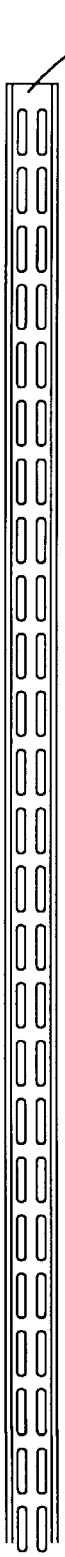
FIG. 8B is a front elevational view of the shelf standard used in the present invention.
Figure 8C:
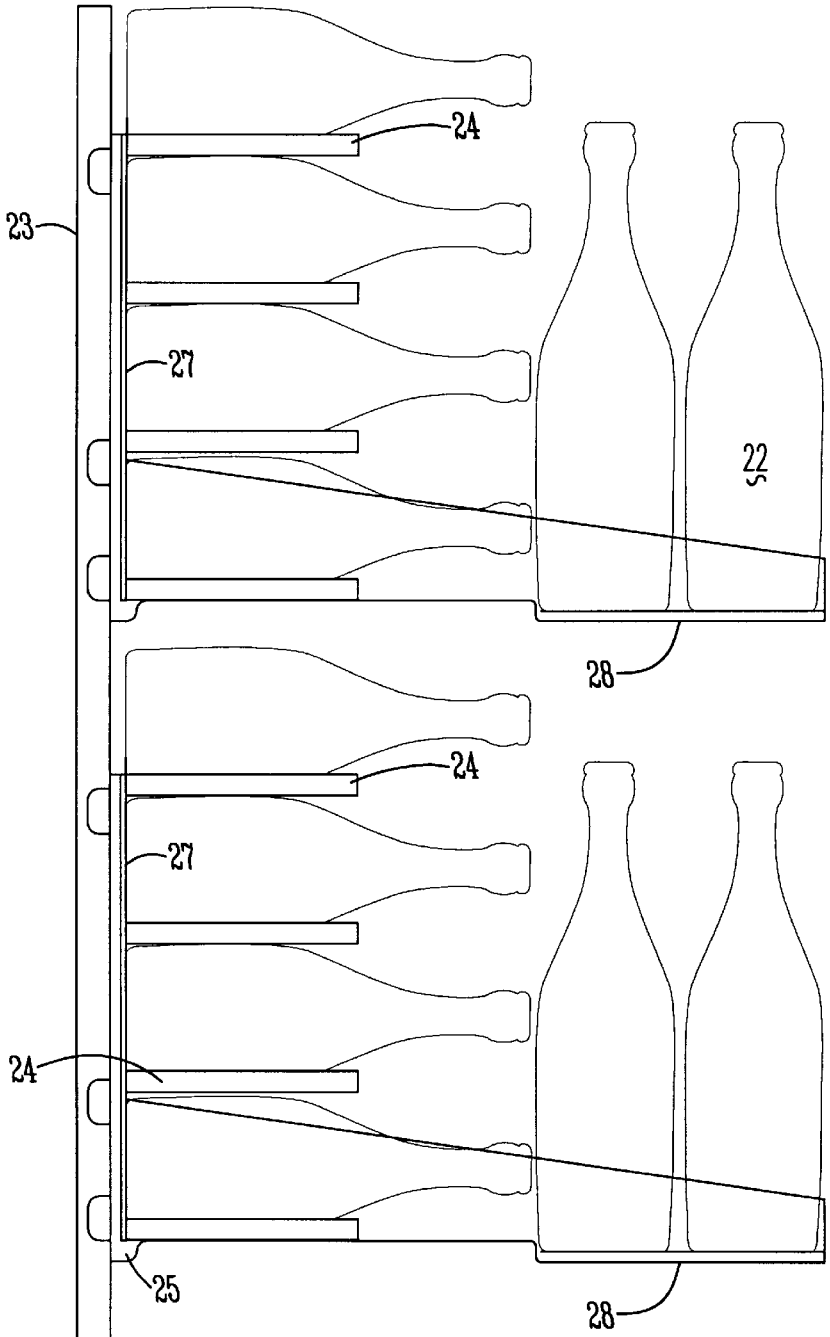
FIG. 8C is a side elevational view showing the "cork down" and "cork up" storage.
Figure 8D:
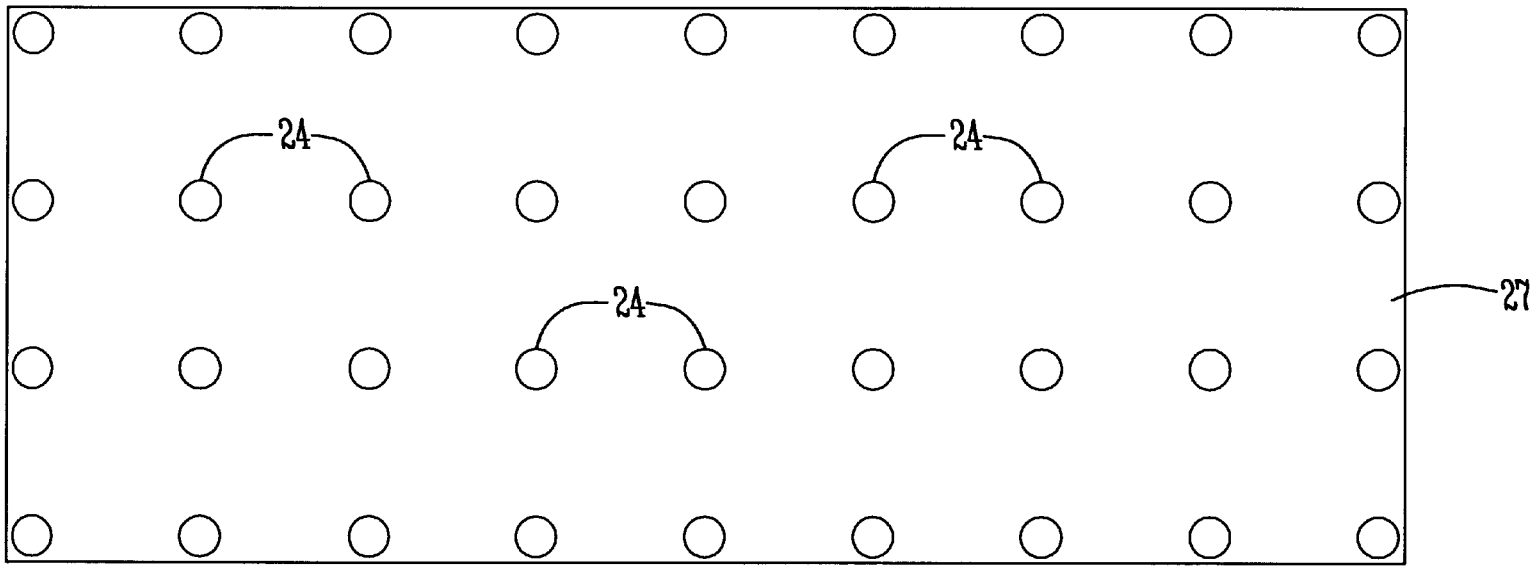
FIG. 8D is a front elevational view of the back plate having the rods extending therefrom.

Also, shelf 28 is likewise cantilevered from rear wall 26 and extends beyond rods 24 so that bottles 22 can be displayed in an upright position simultaneously with bottles in the vertical or "cork down" position resting on rods 24. This relationship is best shown in FIGS. 5–7.

A plurality of these vertical and horizontal display units, comprising one shelf 28 and a plurality of rods 24 can be positioned one above another provided the shelf 28 of one unit is a sufficient distance above shelf 28 of another unit to allow a bottle 22 to stand in a vertical position. The rods 24 can be of varying lengths also to accommodate more than one bottle in a horizontal position.

As can be seen, there are no horizontal or vertical dividers and therefore the present invention allows for greatly improved flexibility in the size and number of bottles displayed. Also, because of the lack of dividers, it is possible to maximize the number of bottles being cellared and displayed.

Although the present invention has been described and illustrated with respect to a preferred embodiment thereof and a preferred use thereof, it is not to be so limited since changes in modifications can be made therein which are within the full intended scope of the invention.

What is claimed is:

1. A combination rack and display shelf for bottles containing a liquid, each of the bottles having a label thereon, an open end, and a closure closing the open end and containing a liquid within the bottle, the combination comprising:

a housing having at least one door for access to a housing interior;

a first support supporting a first group of the bottles in an orientation causing the liquid within each of the first group of bottles to be in contact with the closure thereof;

the first support comprising a plurality of rods and a plate with apertures receiving the rods;

a second support supporting a second group of the bottles in an orientation making the label on each of the bottles in the second group visible upon access to the housing.

2. The combination wine rack and display shelf of claim 1 wherein the second means includes a shelf.

3. The combination wine rack and display shelf of claim 2 further comprising the plate is mounted to a shelf standard.

4. The combination wine rack and display shelf of claim 3 wherein the shelf standard is mounted to the wall and the plate is mounted to the shelf standard.

5. The combination wine rack and display shelf of claim 4 wherein the shelf is mounted to the shelf standard.

6. A combination wine rack and display shelf comprising:

a housing having at least one door;

a plate with a plurality of apertures mounted inside the housing;

at least two rods which engage the plate at the apertures capable of supporting a first bottle in a substantially horizontal position; and a shelf mounted inside the housing capable of supporting a second bottle between the rods and the door.

7. The combination wine rack and display shelf of claim 6 wherein the rods are removably mountable on the plate.

8. The combination wine rack and display shelf of claim 7 wherein the shelf is removably mounted.

9. The combination wine rack and display shelf of claim 8 wherein the shelf is capable of supporting the second bottle in a generally upright position.

10. The combination wine rack and display shelf of claim 9 wherein the rods are round.

11. The combination wine rack and display shelf of claim 10 wherein the shelf is located below the rods.

12. The combination wine rack and display shelf of claim 11 wherein the shelf and rods are integrally formed.

13. A method for storing and displaying a plurality of bottles each having a label thereon, an open end, a liquid therein, and a closure closing the open end with the liquid within the bottle, the method comprising:

maintaining a desired environment within an enclosure with at least one door;

supporting a first group of the bottles within the enclosure on a plurality of rods extending from apertures in a plate, the bottles of the first group each being supported in a position causing the liquid within each of the bottles in the first group to contact the closure thereof;

supporting a second group of the bottles within the enclosure in an orientation wherein the label on each of the bottles in the second group is visible and the second group of bottles is generally in front of the first group of bottles.

* * * * *